US009013532B2

(12) United States Patent
Komai et al.

(10) Patent No.: US 9,013,532 B2
(45) Date of Patent: Apr. 21, 2015

(54) LIGHT SOURCE CONTROL APPARATUS AND IMAGE FORMING APPARATUS

(75) Inventors: Kunihiro Komai, Osaka (JP); Masayuki Hayashi, Osaka (JP); Hiroaki Ikeda, Osaka (JP); Takeshi Shikama, Osaka (JP); Akinori Yamaguchi, Osaka (JP); Tatsuya Miyadera, Osaka (JP); Motohiro Kawanabe, Osaka (JP); Yoshinori Shirasaki, Osaka (JP); Takuhei Yokoyama, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/593,705

(22) Filed: Aug. 24, 2012

(65) Prior Publication Data

US 2013/0063536 A1 Mar. 14, 2013

(30) Foreign Application Priority Data

Sep. 9, 2011 (JP) ..... 2011-197246

(51) Int. Cl.

| | |
|---|---|
| ***G03G 15/043*** | (2006.01) |
| ***B41J 2/45*** | (2006.01) |
| ***B41J 2/47*** | (2006.01) |
| ***G03G 15/00*** | (2006.01) |

(52) U.S. Cl.

CPC ..... *G03G 15/043* (2013.01); *B41J 2/45* (2013.01); *B41J 2/47* (2013.01); *G03G 15/5033* (2013.01)

(58) Field of Classification Search

CPC ..... B41J 2/45; B41J 2/47

See application file for complete search history.

(56) References Cited

U.S. PATENT DOCUMENTS

| | | | | |
|---|---|---|---|---|
| 5,315,320 | A * | 5/1994 | Murano | 347/180 |
| 6,124,875 | A * | 9/2000 | Inukai | 347/237 |
| 6,714,748 | B1 * | 3/2004 | Nakayasu et al. | 399/72 |
| 2003/0218671 | A1 * | 11/2003 | Nagafusa et al. | 347/246 |
| 2007/0109572 | A1 * | 5/2007 | Kitamura | 358/1.9 |
| 2009/0066779 | A1 * | 3/2009 | Sowa et al. | 347/238 |
| 2010/0254723 | A1 | 10/2010 | Tanaka | |

FOREIGN PATENT DOCUMENTS

| | | |
|---|---|---|
| CN | 1967401 A | 5/2007 |
| JP | 2002-096505 | 4/2002 |

OTHER PUBLICATIONS

Chinese Office Action issued Sep. 22, 2014 in Chinese Patent Application No. 201210331433.6 (with English translation).

* cited by examiner

*Primary Examiner* — Justin Seo
*Assistant Examiner* — Kendrick Liu
(74) *Attorney, Agent, or Firm* — Oblon, McClelland, Maier & Neustadt, L.L.P.

(57) ABSTRACT

A light source control apparatus which controls, based on image data input, light emission of a light source which forms an electrostatic latent image on an image bearing body in an electrophotographic image forming apparatus is disclosed, including a pattern generating unit which generates an internal pattern for position aligning and concentration correcting according to the image data; and a mirroring processing unit which performs a process of mirroring the image data and the internal pattern at a later stage of the pattern generating unit.

17 Claims, 5 Drawing Sheets

| MEMORY READ DATA (16bit) | | |
|---|---|---|
| | 8 | 16 |
| | 8 | 16 |
| | 7 | 15 |
| | 7 | 15 |
| | 6 | 14 |
| | 6 | 14 |
| | 5 | 13 |
| | 5 | 13 |
| 1 PIXEL | 4 | 12 |
| | 4 | 12 |
| | 3 | 11 |
| | 3 | 11 |
| | 2 | 10 |
| | 2 | 10 |
| | 1 | 9 |
| | 1 | 9 |

| MEMORY READ DATA (16bit) | | |
|---|---|---|
| | 9 | 1 |
| | 9 | 1 |
| | 10 | 2 |
| | 10 | 2 |
| | 11 | 3 |
| | 11 | 3 |
| | 12 | 4 |
| | 12 | 4 |
| 1 PIXEL | 13 | 5 |
| | 13 | 5 |
| | 14 | 6 |
| | 14 | 6 |
| | 15 | 7 |
| | 15 | 7 |
| | 16 | 8 |
| | 16 | 8 |

LIGHT SOURCE CONTROL APPARATUS AND IMAGE FORMING APPARATUS

TECHNICAL FIELD

The present invention relates to light source control apparatuses which control light emission of a light source in an image forming apparatus using electrophotography and image forming apparatuses which are provided with the same.

BACKGROUND ART

In an image forming apparatus using electrophotography, according to image data, a light source is caused to emit light onto a surface of an image bearing body such as a photoconductor drum which is charged to a predetermined electric potential to form an electrostatic latent image and a developing apparatus is used to attach toner to the electrostatic latent image to form a toner image.

As a light source used for exposing an image bearing body, an LED array in which multiple LEDs (light emitting diodes) and an LD (laser diode) are arranged in one dimension is being commercialized.

The LD emits light in correspondence with the image data while scanning the surface of the image bearing body to perform light exposure, the LED array is provided parallel to a sheet width direction, and multiple LEDs are caused to emit light simultaneously in correspondence with the image data to perform the light exposure on the image bearing body.

Here, an inverted image may be formed when the image data transmitted from a controller of the image forming apparatus are output as they are, depending on a scanning direction of the LD or a fixing direction of the LED array. Thus, in a light source control apparatus which controls light emitting of such a light source, it is common to perform a mirroring process which inverts the image data.

For example, in Patent Document 1, an image forming apparatus is disclosed which makes it possible to always form high quality images without causing any variation in an edge process of pixel data of a target image portion and a reference image portion by performing image processing such that output data of an image at the time of forward scan outputting of a mirroring output unit and output data of an image at the time of reverse scan outputting of a mirroring output unit become symmetrical between the left and the right.

In the image forming apparatus in Patent Document 1, the image data are stored in a buffer memory and a mirroring process is performed by a mirroring processing circuit which is connected to the buffer memory.

Therefore, it is necessary to separately provide a mirroring processing circuit to perform the image data process on an internal pattern such as concentration correcting data, position aligning data, etc., which are generated after the mirroring processing circuit, leading to a cost increase due to an increase in processing size and circuit size.

Patent Document

Patent Document 1: JP2002-96505A

DISCLOSURE OF THE INVENTION

Thus, an object of the present invention is to provide a light source control apparatus which performs a mirroring process of an internal pattern and image data in a simple configuration while not causing a cost increase due to an increase in circuit size and processing size and an image forming apparatus which provides the same.

According to an embodiment of the present invention, a light source control apparatus which controls, based on image data input, light emission of a light source which forms an electrostatic latent image on an image bearing body in an electrophotographic image forming apparatus is provided, including a pattern generating unit which generates an internal pattern for position aligning and concentration correcting according to the image data; and a mirroring processing unit which performs a process of mirroring the image data and the internal pattern at a later stage than the pattern generating unit.

An embodiment of the invention makes it possible to provide a light source control apparatus which performs a mirroring process of image data while not causing an increase in circuit size and processing size by performing a mirroring process at a later stage than a pattern generating unit which generates an internal pattern and an image forming apparatus which provides the same.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Below, preferred embodiments (below called "embodiments") of the present invention are described in detail using the drawings.

Figure 1:
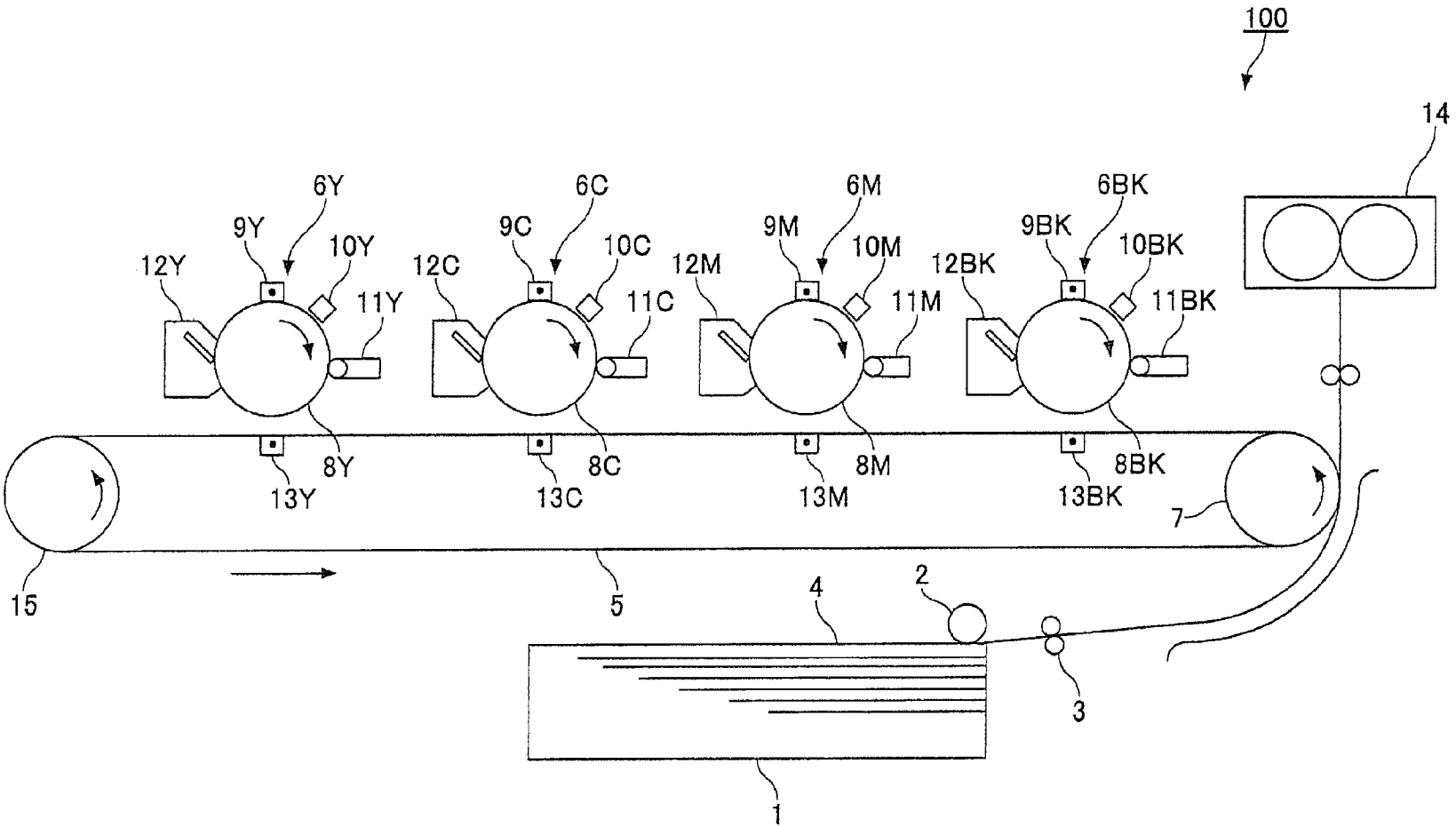
FIG. 1 is a schematic configuration diagram of an image forming apparatus according to an embodiment.

FIG. 1 is a schematic configuration of an image forming apparatus 100 according to the present embodiment.

The image forming apparatus 100 according to the present embodiment is a so-called "tandem-type" color image forming apparatus which includes a configuration in which image forming units 6 of different colors are arranged along a transfer belt 5.

With respect to the image forming units 6, image forming units 6BK, 6M, 6C, and 6Y are arranged which form toner images of respective colors of black (BK), magenta (M), cyan (C), and yellow (Y) from the upstream side in a moving direction of the transfer belt 5. With respect to these multiple image forming units 6BK, 6M, 6C, and 6Y, an internal configuration is common with only colors of toner images formed being different.

In the explanations below, the image forming unit 6BK is specifically described, while only letters identified by M, C, and Y are shown in the figures for each element of the other image forming units 6M, 6C, and 6Y, so that explanations thereof are omitted.

The transfer belt 5 is an endless belt which is wound around a follower roller 15 and a drive roller 7 rotationally driven.

The drive roller 7 is rotationally driven with a drive motor (not shown) to function as a drive unit which drives the transfer belt 5 in an arrow direction (shown).

The image forming unit 6BK includes a photoconductor drum 8BK as an image bearing body; a charger 9BK which is arranged around the photoconductor drum 8BK; an LED head 10BK as a light source which performs light exposure on the photoconductor drum 8BK; a developer 11BK; a photoconductor cleaner 12BK, etc.

At a time of image forming, after an outer peripheral face of the photoconductor drum 8BK is uniformly charged with the charger 9BK in the dark, a portion corresponding to a black image out of image data undergoes light exposure by the LED head 10BK, so that an electrostatic latent image is formed.

Here, the LED head 10 according to the present embodiment is an LED array in which light emitting diodes (LEDs) as light emitting devices are arranged in predetermined intervals. The LED array has advantages that mechanical wear or noise does not occur as a mechanical drive unit is not needed, that the image forming apparatus 100 may be made smaller as a space which it occupies is relatively small, etc.

Moreover, an EL array which uses an organic EL device rather than the LED as the light emitting device may also be used as a light source which performs light exposure on a photoconductor drum 8. A light emitting variation of the EL array, which may be manufactured as a lengthy one collectively at low cost, is relatively small, making it possible to improve image quality.

Furthermore, an optical scanning scheme can be used which optically scans, with a light deflector, a light beam emitted from a light source such as an LD, etc., and forms a light spot with a scanning and imaging lens.

The developer 11BK attaches black toner to the electrostatic latent image which is formed on the photoconductor drum 8BK to produce a visualized image, so that a black toner image is formed on the photoconductor drum 8BK.

The toner image formed on the photoconductor 8BK is transferred to the transfer belt 5 with a primary transfer unit 13BK at a position in which the photoconductor drum 8BK and the transfer belt 5 neighbor. After toner which remained on a surface is wiped off with the photoconductor cleaner 12BK, the photoconductor drum 8BK from which the transferring of the toner image is completed is neutralized with a neutralizer (not shown) and is offered for the next image forming.

The transfer belt 5 to which the black toner image is transferred with the image forming unit 6BK is rotationally driven, so that the toner images of magenta, cyan, and yellow that are formed at the image forming units 6M, 6C, and 6Y are transferred such that they are overlapped and a full color toner image is formed on the transfer belt 5.

With a paper-supplying roller 2 and a separating roller 3, sheets 4 are supplied from a paper-supply tray 1 in a manner that they are separated on a sheet by sheet basis, and a full color toner image foamed on the transfer belt 5 is secondarily transferred to a surface of the sheets 4 at a portion which is in contact with the transfer belt 5.

The sheets 4 which have born thereon a full color toner image are further conveyed to have heat and pressure applied at a fixer 14, so that the toner image is fixed, being discharged to outside the image forming apparatus 100.

Next, a configuration of a light source control apparatus which controls light emission of the LED head 10 as a light source according to the present embodiment is described.

Figure 2:
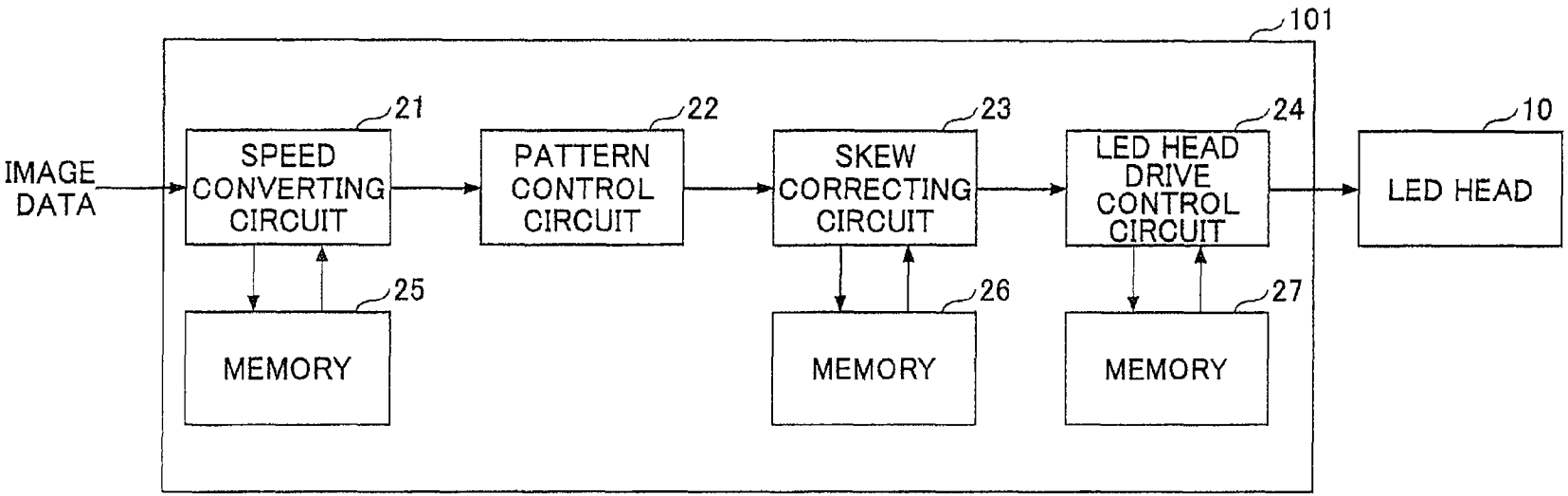
FIG. 2 is a block diagram of a light source control apparatus of the image forming apparatus according to the embodiment.

FIG. 2 is a block diagram of a light source control apparatus 101 of the image forming apparatus 100 according to the present embodiment.

The light source control apparatus 101 includes a speed converting circuit 21; a pattern generating circuit 22; a skew correcting circuit 23; and an LED head drive control circuit 24 as a drive controller which transmits a drive signal to the light source.

Moreover, the speed converting circuit 21, the pattern generating circuit 22, and the skew correcting circuit 23 respectively include memories 25, 26, and 27 from which the image data are read and to which the image data are written for processing.

It suffices that the memory provided at the speed converting circuit 21, the skew correcting circuit 23, and the LED head drive control circuit 24 may temporary store various information sets, so that a DRAM (dynamic random access memory) or an SRAM (static random access memory) may be used.

The DRAM, which can transfer, at high speed, data with consecutive addresses, is suitable for data transferring into a line memory. Moreover, the SRAM is preferable since its consumed power is small, it is possible to put thereinto and take therefrom information at high speed, and it can process at an increased speed, so that the SRAM is used in the present embodiment.

The speed converting circuit 21 frequency converts image data transmitted from a controller of the image forming apparatus 100 to convert a transfer speed.

According to the image data for which the speed is converted with the speed converting circuit 21, various internal patterns such as an alignment pattern, a concentration correcting pattern, a test pattern, etc., are generated in the pattern generating circuit 22 as a pattern generating unit.

Next, in the skew correcting circuit 23, at a later stage than the pattern generating circuit 22, for the generated internal pattern and the transferred image data, correcting is performed of a skew (an inclination of an image) which is caused by a waviness of an LED device which is mounted to the LED head 10. The optical scanning exposing apparatus using the LD, etc., can also perform skew correcting with the speed converting circuit 21.

The image data and the internal pattern that are skew corrected with the skew correcting circuit 23, at the LED head drive control circuit 24, become an I/F signal to be transferred to the LED head 10, and the I/F signal is output to the LED head 10.

The LED head 10 emits light based on the transferred I/F signal to form the electrostatic latent image on the photoconductor drum 8 which is charged uniformly.

Here, depending on a direction in which the LED head 10 is fixed, there may a case in which a light emitting position of the LED head 10 and a position of a pixel in image data to be a basis for the transferred I/F signal may be reversed in a sheet width direction of the sheet, in which case a need arises to perform a mirroring process which inverts image data in the light emission control apparatus.

While the mirroring process of the image data can also be performed in the speed converting circuit 21, an image data width does not match the number of LED devices of the LED head 10 at the stage of the speed converting circuit 21, so that the mirroring process becomes complex. Moreover, when the mirroring process is performed with the speed converting circuit 21, the mirroring process is separately required also for the internal pattern generated with the pattern generating circuit 22, causing the process size and the circuit size to increase.

A First Embodiment

Then, with a light source control apparatus according to a first embodiment, a process of mirroring image data is performed using a memory 26 for processing data by writing thereto and reading therefrom, which memory 26 is provided in the skew correcting circuit 23 at a later stage than the pattern generating circuit 22.

Figure 3:
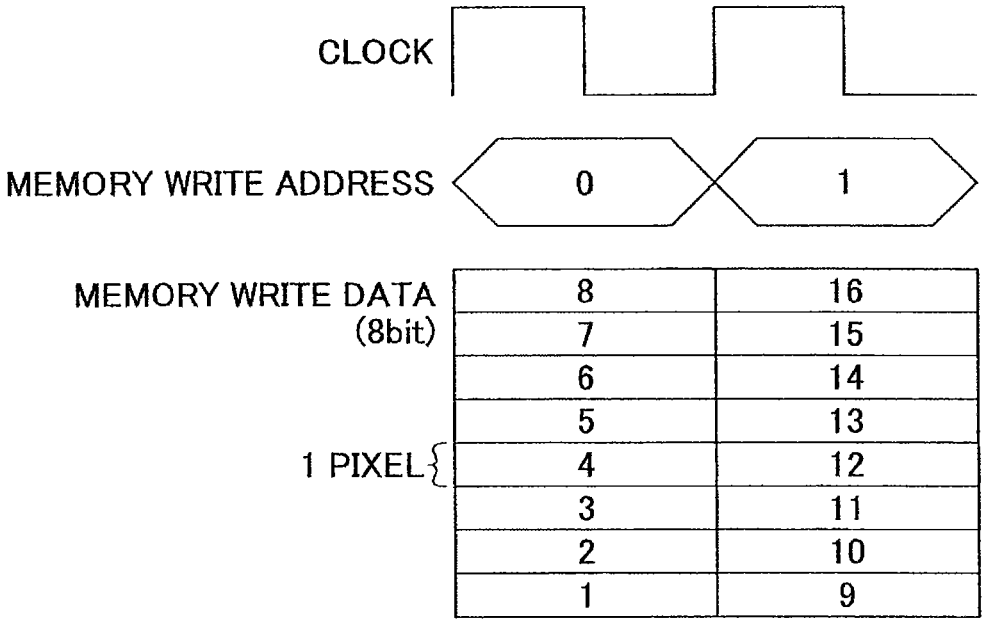
FIG. 3 is a diagram which explains an operation of writing image data into a memory in a light source control apparatus according to the embodiment.

FIG. 3 is a diagram which explains an operation of writing image data into the memory 26 in the light source control apparatus 101 according to the embodiment.

Data corresponding to eight pixels are written in one clock into the memory 26 from the skew correcting circuit 23. In this way, multiple pixels of the image data can be processed in parallel to increase the speed of the process.

The image data are written in address increments such as 0, 1, 2, . . . , N−1, N for a write address of the memory 26.

Figure 4:
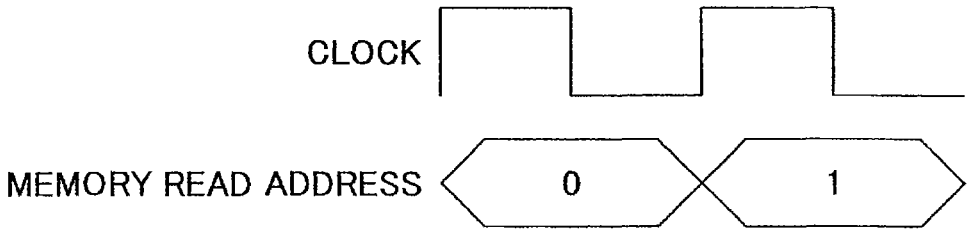
FIG. 4 is a diagram which explains a memory reading operation without a mirroring process in the light source control apparatus according to the embodiment.

FIG. 4 is a diagram which explains an operation of reading image data from the memory 26 without a mirroring process in the light source control apparatus 101 according to the present embodiment.

The image data are read in address increments such as 0, 1, 2, . . . , N−1, and N for a read address of the memory 26, in the same order the image data are written, so that it becomes an image data reading operation without the mirroring process.

Here, when the image data are read from the memory 26, one pixel is read such that it is expanded into 2 bits.

Figure 5:
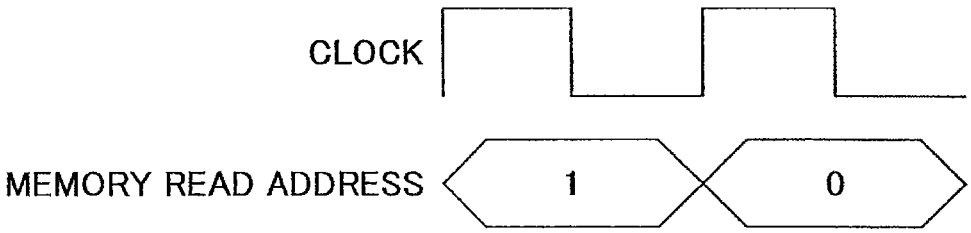
FIG. 5 is a diagram which explains a memory reading operation with the mirroring process in the light source control apparatus according to the embodiment.

Next, FIG. 5 is a diagram which explains an operation of reading image data from the memory 26 with the mirroring process in the light source control apparatus 101 according to the present embodiment.

The mirroring process is carried out while performing an arrangement conversion of higher and lower bits as well as expanding one pixel into 2 bits in address decrements such as N, N−1, . . . , 1, 0 for the read address of the memory 26.

In this way, in the skew correcting circuit 23, the memory 26 can be used to perform the mirroring process, making it possible to perform the process of mirroring the image data in a simple configuration without increasing the process size and the circuit size.

A Second Embodiment

In the light source control apparatus 101 according to the second embodiment, a memory 27 provided at the LED head drive control circuit 24 at a later stage than the pattern generating circuit 22, is used to perform a process of mirroring image data.

The configurations of the image forming apparatus 100 and the light source control apparatus 101 according to the second embodiment are respectively the same as the configurations shown in FIGS. 1 and 2.

The processing of the image data into the memory 27 of the LED head drive control circuit 24 is performed by carrying out a mirroring process while also converting arrangement of the image data in address decrements after writing the image data in the address increments as shown in FIGS. 3 to 5.

In the LED head drive control circuit 24 provided in the later stage of the pattern generating circuit 22, the memory is used to perform the mirroring process, making it possible to perform the mirroring process without increasing the process size and the circuit size.

Concluding Remarks

As described above, according to the present invention, the mirroring process is performed in the LED drive control circuit 24 or the skew correcting circuit 23 at a later stage than the pattern generating circuit 22 which generates the internal pattern, making it possible to perform the process of mirroring the image data without increasing the process size and the circuit size.

The present invention is not limited to configurations shown herein such as configurations listed in the above embodiments, a combination thereof with the other elements, etc. These matters can be changed without departing from the spirit of the present invention, so that they may be appropriately determined according to the applicable embodiments thereof.

The present application is based on Japanese Priority Application No. 2011-197246 filed on Sep. 9, 2011, the entire contents of which are hereby incorporated by reference.

The invention claimed is:

1. A light source control apparatus which controls, based on image data, light emission of a light source which forms an electrostatic latent image on an image bearing body in an electrophotographic image forming apparatus, comprising:

a speed converting unit which converts the image data to convert a transfer speed of the image data;

a pattern generating unit which generates an internal pattern for position aligning and concentration correcting according to the image data at a later stage than the speed converting circuit; and a mirroring processing unit which performs a process of mirroring the image data in addition to mirroring the internal pattern at a later stage than the pattern generating unit.

2. The light source control apparatus as claimed in claim 1, wherein the mirroring processing unit is provided at a skew correcting unit which performs inclination correcting of at least the image data at the later stage than the pattern generating unit.

3. The light source control apparatus as claimed in claim 2, wherein the skew correcting unit includes a memory to which are written and from which are read the image data and the internal pattern for processing, and wherein the mirroring processing unit performs a mirroring process when reading the image data and the internal pattern written into the memory.

4. The light source control apparatus as claimed in claim 3, wherein the memory is an SRAM.

5. The light source control apparatus as claimed in claim 1, wherein the mirroring processing unit is provided at a drive control unit which transmits a drive signal to the light source based on the image data and the internal pattern at the later stage than the pattern generating unit.

6. The light source control apparatus as claimed in claim 5, wherein the drive control unit includes a memory to which the internal pattern is written and from which the image data is read for processing, and wherein the mirroring processing unit performs a mirroring process when reading the image data and the internal pattern written into the memory.

7. The light source control apparatus as claimed in claim 5, further comprising a skew correcting unit which performs inclination correcting of at least the image data at a different stage than the pattern generating unit.

8. The light source control apparatus as claimed in claim 7, wherein the pattern generating unit generates the internal pattern according to the image data at a later stage than the skew correcting unit.

9. The light source control apparatus as claimed in claim 7, wherein the inclination correcting of at least the image data includes inclination correcting of the internal pattern.

10. The light source control apparatus as claimed in claim 1, wherein the mirroring processing unit processes in parallel multiple pixels of the image data.

11. An image forming apparatus, comprising a light source control apparatus as claimed in claim 1.

12. The image forming apparatus as claimed in claim 11, wherein the light source is an LED array at which multiple light emitting diodes are arranged.

13. The image forming apparatus as claimed in claim 11, wherein the light source is an LED array at which multiple organic EL devices are arranged.

14. The light source control apparatus as claimed in claim 1, further comprising a skew correcting unit which performs inclination correcting of at least the image data at a different stage than the pattern generating unit.

15. The light source control apparatus as claimed in claim 14, wherein the pattern generating unit generates the internal pattern according to the image data at a later stage than the skew correcting unit.

16. The light source control apparatus as claimed in claim 14, wherein the inclination correcting of at least the image data includes inclination correcting of the internal pattern.

17. The light source control apparatus as claimed in claim 1, wherein the speed converting unit includes a memory to which the image data is written and from which the image data is read for processing, and wherein the speed converting unit performs a converting process when reading the image data written into the memory.

* * * * *